US012767298B2

(12) United States Patent
Kan

(10) Patent No.: US 12,767,298 B2
(45) Date of Patent: Oct. 20, 2026

(54) MARINE PROPULSION DEVICE AND MARINE VESSEL

(71) Applicant: YAMAHA HATSUDOKI KABUSHIKI KAISHA, Iwata (JP)

(72) Inventor: Yoshitaka Kan, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 364 days.

(21) Appl. No.: 18/522,333

(22) Filed: Nov. 29, 2023

(65) Prior Publication Data

US 2024/0190546 A1 Jun. 13, 2024

(30) Foreign Application Priority Data

Dec. 9, 2022 (JP) ..... 2022-197116

(51) Int. Cl.
*B63H 1/16* (2006.01)

(52) U.S. Cl.
CPC ..... *B63H 1/16* (2013.01)

(58) Field of Classification Search
CPC ..... B63H 1/16; B63H 5/14; H02K 2201/03
See application file for complete search history.

(56) References Cited

U.S. PATENT DOCUMENTS 5,607,329 A 3/1997 Cho et al.
5,722,864 A 3/1998 Andiarena
6,692,319 B2 * 2/2004 Collier ..... B63H 1/16 440/38
8,840,378 B2 * 9/2014 Tanaka ..... B63H 23/24 417/356
12,528,572 B2 * 1/2026 Ikegaya ..... B63H 20/12
2003/0186601 A1 * 10/2003 Collier ..... B63H 1/16 440/66
2013/0115832 A1 5/2013 Suzuki et al.
2013/0115833 A1 * 5/2013 Suzuki ..... B63H 5/14 440/2
2018/0257750 A1 * 9/2018 Suzuki ..... B63H 1/16
2024/0109632 A1 * 4/2024 Arvidsson ..... B63H 5/20
2024/0262475 A1 * 8/2024 Tanimura ..... B63H 5/14

FOREIGN PATENT DOCUMENTS

CN 113511322 A * 10/2021 ..... B63H 5/16
CN 215043605 U * 12/2021 ..... B63H 1/16
CN 114670999 A * 6/2022 ..... B63H 1/14
(Continued)

OTHER PUBLICATIONS

English translation for CN-114670999 (Year: 2022).*
(Continued)

*Primary Examiner* — Jong-Suk (James) Lee
(74) *Attorney, Agent, or Firm* — Keating & Bennett, LLP

(57) ABSTRACT

A marine propulsion device includes an entry suppressor extending circumferentially between an inner peripheral surface of a duct and an outer peripheral surface of a rim in a radial direction of a rotor to reduce or prevent entry of foreign matter into a gap between the inner peripheral surface of the duct and the outer peripheral surface of the rim. The entry suppressor has a thickness larger than a minimum width of the gap and smaller than a maximum width of the gap in the radial direction of the rotor.

20 Claims, 4 Drawing Sheets

(56) References Cited

FOREIGN PATENT DOCUMENTS

| | | | | | |
|---|---|---|---|---|---|
| CN | 121224958 | A | * | 12/2025 | ..... B63H 1/16 |
| DE | 3718954 | A1 | * | 12/1988 | ..... H02K 7/14 |
| DE | 10353566 | A1 | * | 6/2005 | ..... B63H 5/125 |
| JP | 61-12496 | A | | 1/1986 | |
| JP | 8-91291 | A | | 4/1996 | |
| JP | 2009-132227 | A | | 6/2009 | |
| JP | 2013-100014 | A | | 5/2013 | |
| JP | 5872255 | B2 | * | 3/2016 | ..... B63H 20/007 |
| JP | 2025180748 | A | * | 12/2025 | ..... H02K 2201/03 |
| JP | 7799419 | B2 | * | 1/2026 | ..... B63H 1/16 |
| WO | WO-2017082248 | A1 | * | 5/2017 | ..... B63H 20/007 |

OTHER PUBLICATIONS

English translation for CN-121224958 (Year: 2025).*
English translation for CN-215043605 (Year: 2021).*
English translation for DE-10353566 (Year: 2005).*
English translation for DE-3718954 (Year: 1988).*
English translation for JP-2025180748 (Year: 2025).*
English translation for JP-5872255 (Year: 2016).*
English translation for JP-7799419 (Year: 2026).*
Official Communication issued in corresponding European Patent Application No. 23210377.0, mailed on May 6, 2024.

* cited by examiner

MARINE PROPULSION DEVICE AND MARINE VESSEL

CROSS REFERENCE TO RELATED APPLICATIONS

This application claims the benefit of priority to Japanese Patent Application No. 2022-197116 filed on Dec. 9, 2022. The entire contents of this application are hereby incorporated herein by reference.

BACKGROUND OF THE INVENTION

1. Field of the Invention

The present invention relates to a marine propulsion device and a marine vessel.

2. Description of the Related Art

A marine propulsion device including an entry suppressor that reduces or prevents entry of foreign matter into a gap between the inner peripheral surface of a duct and the outer peripheral surface of a rim is known in general. Such a marine propulsion device is disclosed in Japanese Patent Laid-Open No. 2013-100014, for example.

Japanese Patent Laid-Open No. 2013-100014 discloses a marine propulsion unit (marine propulsion device) including a duct including a stator, and a propeller including a rim that includes a rotor located radially inwardly of the stator so as to face the stator, and blades provided radially inwardly of the rim. The propeller including the rim and the blades rotates with respect to the duct. Furthermore, Japanese Patent Laid-Open No. 2013-100014 discloses a marine propulsion unit further including a seal (entry suppressor) or a dust-proof ring (entry suppressor) that reduces or prevents entry of foreign matter into a gap between the inner peripheral surface of a duct and the outer peripheral surface of a rim, in addition to the structures described above.

In the marine propulsion unit including the seal disclosed in Japanese Patent Laid-Open No. 2013-100014, the annular seal and an annular securing ring that secures the seal to the rim and the duct are provided in the vicinity of the gap between the inner peripheral surface of the duct and the outer peripheral surface of the rim. The seal and the securing ring seal the gap between the inner peripheral surface of the duct and the outer peripheral surface of the rim. The seal contacts the rim over the entire circumference.

In the marine propulsion unit including the dust-proof ring disclosed in Japanese Patent Laid-Open No. 2013-100014, the annular dust-proof ring is located in the vicinity of the gap between the inner peripheral surface of the duct and the outer peripheral surface of the rim. The dust-proof ring does not contact the rim over the entire circumference. The dust-proof ring includes slits each having a width smaller than the gap between the inner peripheral surface of the duct and the outer peripheral surface of the rim to prevent entry of foreign matter larger than the gap between the inner peripheral surface of the duct and the outer peripheral surface of the rim into the gap. The slits are provided over the entire circumference of the dust-proof ring.

However, in the marine propulsion unit (marine propulsion device) including the seal (entry suppressor) disclosed in Japanese Patent Laid-Open No. 2013-100014, the seal contacts the rim over the entire circumference, and thus a frictional force generated between the seal and the rim becomes relatively large when the rim rotates. In such a case, the amount of power consumed to rotate the rim increases and the maximum output of a motor including the stator and the rotor decreases as the frictional force increases. On the other hand, in the marine propulsion unit (marine propulsion device) including the dust-proof ring (entry suppressor) disclosed in Japanese Patent Laid-Open No. 2013-100014, the dust-proof ring does not contact the rim over the entire circumference, and thus a frictional force is not generated between the seal and the rim when the rim rotates.

In the marine propulsion unit including the dust-proof ring disclosed in Japanese Patent Laid-Open No. 2013-100014, it is necessary to provide the dust-proof ring in which the slits each having a width smaller than the gap between the inner peripheral surface of the duct and the outer peripheral surface of the rim are provided over the entire circumference. That is, it is necessary to provide the dust-proof ring having a relatively complex structure in the marine propulsion unit. Therefore, a marine propulsion device is desired that reduces or prevents entry of foreign matter into a gap between the inner peripheral surface of a duct and the outer peripheral surface of a rim without providing an entry suppressor having a relatively complex structure, while reducing or preventing an increase in the amount of power consumed to rotate the rim and a decrease in the maximum output of a motor.

SUMMARY OF THE INVENTION

Preferred embodiments of the present invention provide marine propulsion devices and marine vessels that each reduce or prevent entry of foreign matter into gaps between inner peripheral surfaces of ducts and outer peripheral surfaces of rims without providing entry suppressors having relatively complex structures, while reducing or preventing increases in amounts of power consumed to rotate rims and decreases in maximum outputs of motors.

A marine propulsion device according to a preferred embodiment of the present invention includes a duct including a stator, a propeller including a rim including a rotor radially inward of the stator and facing the stator, and blades extending radially inward of the rim, and an entry suppressor made of an expansible and shrinkable material and extending circumferentially between an inner peripheral surface of the duct and an outer peripheral surface of the rim in a radial direction of the rotor to reduce or prevent entry of foreign matter into a gap between the inner peripheral surface of the duct and the outer peripheral surface of the rim in the radial direction. The entry suppressor has a thickness larger than a minimum width of the gap and smaller than a maximum width of the gap in the radial direction. The gap between the inner peripheral surface of the duct and the outer peripheral surface of the rim is non-uniform or substantially non-uniform in the circumferential direction of the rotor due to manufacturing errors (tolerances) of the duct and the rim.

In a marine propulsion device according to a preferred embodiment of the present invention, in the radial direction, the thickness of the entry suppressor is larger than the minimum width of the gap and smaller than the maximum width of the gap. Accordingly, in a portion of the gap having the minimum width, the entry suppressor is shrunk to a thickness that is the same or substantially the same as the minimum width of the gap, and contacts the inner peripheral surface of the duct and the outer peripheral surface of the rim. Furthermore, in the vicinity of a portion of the gap having the maximum width, the entry suppressor does not contact at least one of the inner peripheral surface of the duct or the outer peripheral surface of the rim. Thus, the entry suppressor contacts the duct and the rim only partially in the circumferential direction, and thus a frictional force generated between the entry suppressor and both the duct and the rim when the rim rotates is reduced as compared with a case in which the entry suppressor contacts the duct and the rim over the entire circumference. Furthermore, the entry suppressor has a simple structure as compared with an entry suppressor in a conventional marine propulsion device in which slits each having a width smaller than a gap between the inner peripheral surface of a duct and the outer peripheral surface of a rim are provided over the entire circumference. Consequently, entry of foreign matter into the gap between the inner peripheral surface of the duct and the outer peripheral surface of the rim is reduced or prevented without providing an entry suppressor having a relatively complex structure, while an increase in the amount of power consumed to rotate the rim and a decrease in the maximum output of a motor are reduced or prevented.

In a marine propulsion device according to a preferred embodiment of the present invention, in the radial direction, a difference between the thickness of the entry suppressor and the maximum width of the gap is preferably smaller than the minimum width of the gap. Accordingly, the maximum particle size of foreign matter entering the gap is smaller than the minimum width of the gap, and thus foreign matter entering the gap is reduced or prevented from being caught in the gap. Thus, wear of the inner peripheral surface of the duct and the outer peripheral surface of the rim caused by the foreign matter entering the gap is reduced or prevented.

In a marine propulsion device according to a preferred embodiment of the present invention, each of the rotor and the stator is preferably covered with a resin, and the entry suppressor is preferably provided between the outer peripheral surface of the rim made of the resin covering the rotor and the inner peripheral surface of the duct made of the resin covering the stator in the radial direction. Accordingly, entry of foreign matter into the gap is reduced or prevented by the entry suppressor such that wear of the inner peripheral surface of the duct and the outer peripheral surface of the rim, both of which are made of the resin that wears more easily than metal, is effectively reduced or prevented.

In such a case, a width in the radial direction between the outer peripheral surface of the rim and the inner peripheral surface of the duct is preferably non-uniform or substantially non-uniform in a circumferential direction of the rotor. Accordingly, assuming that the thickness of the entry suppressor in the radial direction is constant, a structure in which the thickness of the entry suppressor is larger than the minimum width of the gap and smaller than the maximum width of the gap in the radial direction is reliably achieved.

In a marine propulsion device according to a preferred embodiment of the present invention, the entry suppressor is preferably made of an expansible and shrinkable foamed rubber. Accordingly, the entry suppressor is easily shrunk to be smaller than the minimum width of the gap.

In such a case, the entry suppressor is preferably attached to either the inner peripheral surface of the duct or the outer peripheral surface of the rim in the gap, and the marine propulsion device preferably further includes a wear suppression layer on either the outer peripheral surface of the rim or the inner peripheral surface of the duct facing the entry suppressor to reduce or prevent wear caused by the foreign matter adhering to the entry suppressor. Accordingly, the entry suppressor is attached to either the inner peripheral surface of the duct or the outer peripheral surface of the rim such that the entry suppressor is easily provided in the gap between the inner peripheral surface of the duct and the outer peripheral surface of the rim. Furthermore, when foreign matter adheres to the foamed rubber of which the entry suppressor is made, the wear suppression layer reduces or prevents wear caused by the foreign matter of either the outer peripheral surface of the rim or the inner peripheral surface of the duct facing the entry suppressor.

In a marine propulsion device according to a preferred embodiment of the present invention, the entry suppressor is preferably attached to the outer peripheral surface of the rim in the gap. Attachment work to attach the entry suppressor to the outer peripheral surface of the rim from the radial outside is easier than attachment work to attach the entry suppressor to the inner peripheral surface of the duct from the radial inside. Therefore, with the structure described above, as compared with a case in which the entry suppressor is attached to the inner peripheral surface of the duct in the gap, the entry suppressor is easily provided in the gap between the inner peripheral surface of the duct and the outer peripheral surface of the rim. Furthermore, the entry suppressor is located on an upper side in the gap on a lower side between the inner peripheral surface of the duct and the outer peripheral surface of the rim, and thus catching of foreign matter entering the gap on the lower side between the inner peripheral surface of the duct and the outer peripheral surface of the rim is reduced or prevented when a state in which the duct and the rim are submerged in water has changed to a state in which the duct and the rim are not submerged in water.

In a marine propulsion device according to a preferred embodiment of the present invention, the entry suppressor is preferably made of a non-magnetic material. Accordingly, the magnetic influence of the entry suppressor on the rotor when the rim including the rotor rotates is reduced or prevented. That is, a decrease in the performance of the motor including the stator of the duct and the rotor of the rim is reduced or prevented.

In a marine propulsion device according to a preferred embodiment of the present invention, the entry suppressor is preferably attached to either the inner peripheral surface of the duct or the outer peripheral surface of the rim. Accordingly, the entry suppressor is easily provided in the gap between the inner peripheral surface of the duct and the outer peripheral surface of the rim.

In such a case, the entry suppressor preferably has a length in an axial direction of the rotor larger than the thickness of the entry suppressor in the radial direction. Accordingly, the length of the entry suppressor in the axial direction of the rotor is relatively large, and thus the attachment area of the entry suppressor to the inner peripheral surface of the duct or the outer peripheral surface of the rim becomes relatively large. Thus, the entry suppressor is relatively firmly attached to the inner peripheral surface of the duct or the outer peripheral surface of the rim.

In a marine propulsion device according to a preferred embodiment of the present invention, the gap preferably extends in an axial direction of the rotor, and the entry suppressor includes a first entry suppressor at a first axial end of the gap and a second entry suppressor at a second axial end of the gap. Accordingly, as compared with a case in which the entry suppressor is provided in a portion of the gap other than the first axial end and the second axial end in the axial direction, entry of foreign matter into the gap is effectively reduced or prevented. Furthermore, as compared with a case in which the entry suppressor is provided in the portion of the gap other than the first axial end and the second axial end in addition to the first axial end and the second axial end of the gap, an area in which the entry suppressor contacts the rim is reduced such that a frictional force generated between the entry suppressor and the rim when the rim rotates is reduced.

In such a case, one end of the rotor in the axial direction and one end of the stator in the axial direction are preferably deviated from each other in the axial direction, and the first entry suppressor at the first axial end of the gap preferably corresponds to a position of the one end of the rotor in the axial direction, and does not correspond to a position of the one end of the stator in the axial direction. Accordingly, even when one end of the rotor in the axial direction and one end of the stator in the axial direction are deviated from each other in the axial direction, the first entry suppressor is provided at the first axial end of the gap.

A marine vessel according to a preferred embodiment of the present invention includes a hull, and a marine propulsion device attached to the hull. The marine propulsion device includes a duct including a stator, a propeller including a rim including a rotor extending radially inward of the stator so as to face the stator, and blades extending radially inward of the rim, and an entry suppressor made of an expansible and shrinkable material and extending circumferentially between an inner peripheral surface of the duct and an outer peripheral surface of the rim in a radial direction of the rotor to reduce or prevent entry of foreign matter into a gap between the inner peripheral surface of the duct and the outer peripheral surface of the rim in the radial direction. The entry suppressor has a thickness larger than a minimum width of the gap and smaller than a maximum width of the gap in the radial direction.

In a marine vessel according to a preferred embodiment of the present invention, in the radial direction, the thickness of the entry suppressor is larger than the minimum width of the gap and smaller than the maximum width of the gap. Accordingly, similarly to the marine propulsion devices according to preferred embodiments of the present invention described above, the entry suppressor contacts the duct and the rim only partially in the circumferential direction of the rotor, and thus a frictional force generated between the entry suppressor and both the duct and the rim when the rim rotates is reduced as compared with a case in which the entry suppressor contacts the duct and the rim over the entire circumference. Furthermore, similarly to the marine propulsion devices according to preferred embodiments of the present invention described above, the entry suppressor has a simple structure as compared with an entry suppressor in a conventional marine propulsion device. Consequently, similarly to the marine propulsion devices according to preferred embodiments of the present invention described above, entry of foreign matter into the gap between the inner peripheral surface of the duct and the outer peripheral surface of the rim is reduced or prevented without providing an entry suppressor having a relatively complex structure, while an increase in the amount of power consumed to rotate the rim and a decrease in the maximum output of a motor are reduced or prevented.

In a marine vessel according to a preferred embodiment of the present invention, in the radial direction, a difference between the thickness of the entry suppressor and the maximum width of the gap is preferably smaller than the minimum width of the gap. Accordingly, similarly to the marine propulsion devices according to preferred embodiments of the present invention described above, wear of the inner peripheral surface of the duct and the outer peripheral surface of the rim caused by foreign matter entering the gap is reduced or prevented.

In a marine vessel according to a preferred embodiment of the present invention, each of the rotor and the stator is preferably covered with a resin, and the entry suppressor is preferably provided between the outer peripheral surface of the rim made of the resin covering the rotor and the inner peripheral surface of the duct made of the resin covering the stator in the radial direction. Accordingly, similarly to the marine propulsion devices according to preferred embodiments of the present invention described above, entry of foreign matter into the gap is reduced or prevented by the entry suppressor such that wear of the inner peripheral surface of the duct and the outer peripheral surface of the rim, both of which are made of the resin that wears more easily than metal, is effectively reduced or prevented.

In such a case, a width in the radial direction between the outer peripheral surface of the rim and the inner peripheral surface of the duct is preferably non-uniform in a circumferential direction of the rotor. Accordingly, similarly to the marine propulsion devices according to preferred embodiments of the present invention described above, assuming that the thickness of the entry suppressor in the radial direction is constant, a structure in which the thickness of the entry suppressor is larger than the minimum width of the gap and smaller than the maximum width of the gap in the radial direction is reliably achieved.

In a marine vessel according to a preferred embodiment of the present invention, the entry suppressor is preferably made of an expansible and shrinkable foamed rubber. Accordingly, similarly to the marine propulsion devices according to preferred embodiments of the present invention described above, the entry suppressor is easily shrunk to be smaller than the minimum width of the gap.

In such a case, the entry suppressor is preferably attached to either the inner peripheral surface of the duct or the outer peripheral surface of the rim in the gap, and the marine propulsion device preferably further includes a wear suppression layer on either the outer peripheral surface of the rim or the inner peripheral surface of the duct facing the entry suppressor to reduce or prevent wear caused by the foreign matter adhering to the foamed rubber. Accordingly, similarly to the marine propulsion devices according to preferred embodiments of the present invention described above, the entry suppressor is attached to either the inner peripheral surface of the duct or the outer peripheral surface of the rim in the gap such that the entry suppressor is easily provided in the gap between the inner peripheral surface of the duct and the outer peripheral surface of the rim. Furthermore, similarly to the marine propulsion devices according to preferred embodiments of the present invention described above, when foreign matter adheres to the foamed rubber of which the entry suppressor is made, the wear suppression layer reduces or prevents wear caused by the foreign matter of either the outer peripheral surface of the rim or the inner peripheral surface of the duct facing the entry suppressor made of the foamed rubber.

In a marine vessel according to a preferred embodiment of the present invention, the entry suppressor is preferably attached to the outer peripheral surface of the rim in the gap. Accordingly, similarly to the marine propulsion devices according to preferred embodiments of the present invention described above, as compared with a case in which the entry suppressor is attached to the inner peripheral surface of the duct in the gap, the entry suppressor is easily provided in the gap between the inner peripheral surface of the duct and the outer peripheral surface of the rim. Furthermore, similarly to the marine propulsion devices according to preferred embodiments of the present invention described above, foreign matter entering the gap on the lower side between the inner peripheral surface of the duct and the outer peripheral surface of the rim is reduced or prevented from being caught in the gap when a state in which the duct and the rim are submerged in water has changed to a state in which the duct and the rim are not submerged in water.

In a marine vessel according to a preferred embodiment of the present invention, the entry suppressor is preferably made of a non-magnetic material. Accordingly, similarly to the marine propulsion devices according to preferred embodiments of the present invention described above, a decrease in the performance of the motor including the stator of the duct and the rotor of the rim is reduced or prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

A marine propulsion device 100 and a marine vessel 110 according to preferred embodiments of the present invention are now described with reference to FIGS. 1 to 5.

Figure 1:
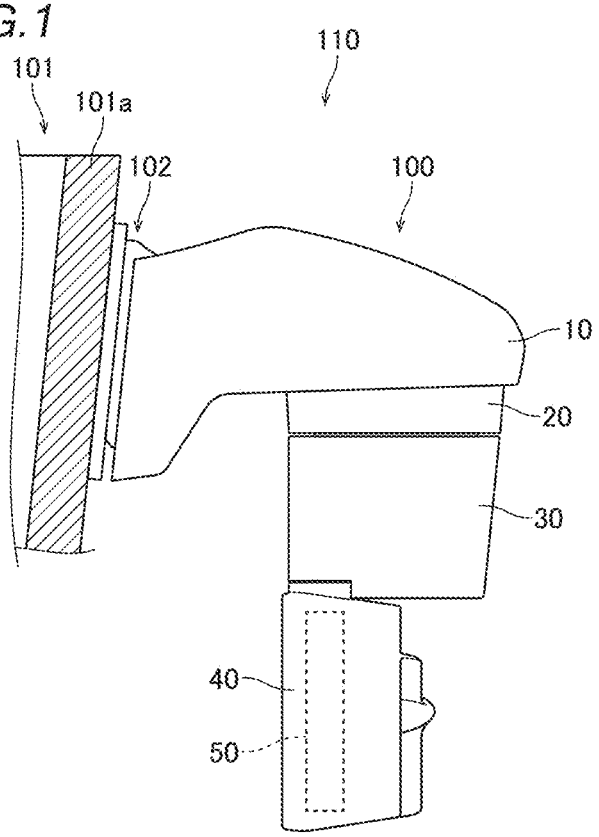
FIG. 1 is a side view of a marine propulsion device according to a preferred embodiment of the present invention.

As shown in FIG. 1, the marine vessel 110 includes a hull 101, a bracket 102, and the marine propulsion device 100. The marine propulsion device 100 is attached to a stern 101*a* of the hull 101 via the bracket 102. That is, the marine propulsion device 100 is an outboard motor to propel the marine vessel 110. The marine vessel 110 may be a relatively small marine vessel used for sightseeing or fishing, for example.

The marine propulsion device 100 includes a cowling 10, an upper case 20, a lower case 30, a duct 40, and a propeller 50. The cowling 10, the upper case 20, the lower case 30, the duct 40, and the propeller 50 are aligned in this order from the top to the bottom of the marine propulsion device 100.

In the following description, the axial direction, radial direction, and circumferential direction of a rotor 54 (see FIG. 3) described below are defined as an A direction, an R direction, and a C direction, respectively. Furthermore, a first side (hull 101 side) and a second side (a side opposite to the hull 101 side) in the axial direction (A direction) of the rotor 54 are defined as an A1 side and an A2 side, respectively. Moreover, the radially inner side and the radially outer side of the rotor 54 are defined as an R1 side and an R2 side, respectively. The central axis 90 (see FIG. 2) of the propeller 50 extends along the A direction.

The cowling 10 is attached to the stern 101*a* of the hull 101 via the bracket 102. The cowling 10 and the upper case 20 are fixed to each other. The lower case 30 and the duct 40 are fixed to each other. The lower case 30 and the duct 40 are rotatable in the right-left direction of the marine propulsion device 100 with respect to the cowling 10 and the upper case 20. The lower case 30 and the duct 40 are rotated with respect to the cowling 10 and the upper case 20 such that the orientation of the propeller 50 with respect to the hull 101 is changed.

Figure 2:
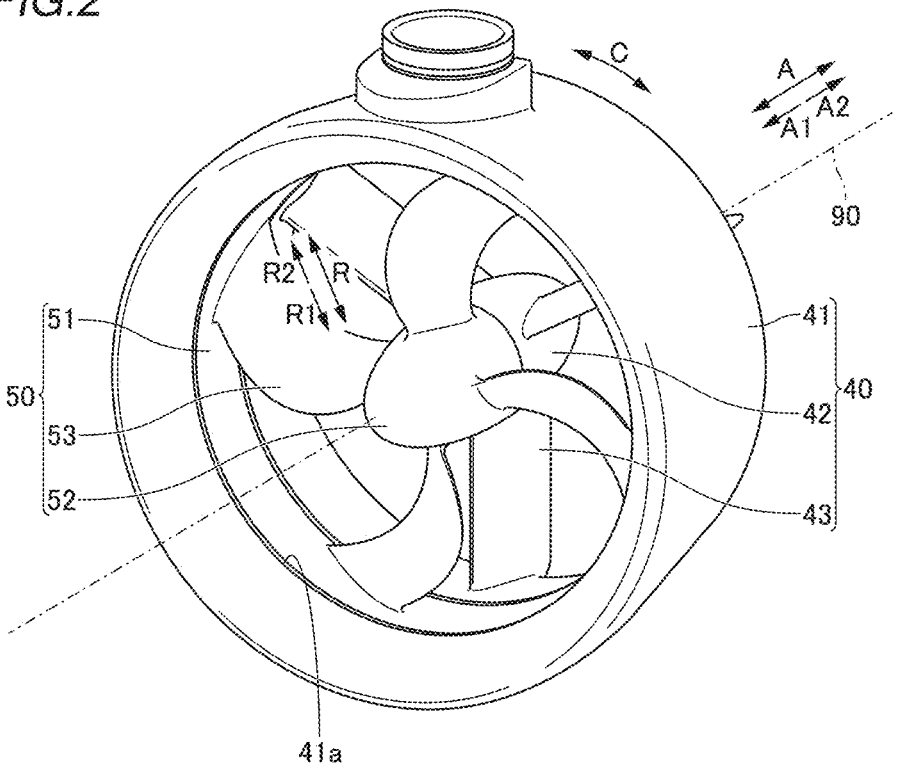
FIG. 2 is a perspective view of a duct and a rim of a marine propulsion device according to a preferred embodiment of the present invention.

As shown in FIG. 2, the duct 40 includes a cylindrical duct ring 41, a duct hub 42 provided on the R1 side of the duct ring 41 and extending along the A direction, and a plurality of fins 43 extending in the R direction to connect the duct hub 42 to the duct ring 41.

The propeller 50 includes an annular rim 51, a propeller hub 52 provided on the R1 side of the rim 51 and extending along the A direction, and a plurality of blades 53 extending in the R direction to connect the propeller hub 52 to the rim 51. That is, the plurality of blades 53 are provided on the R1 side of the rim 51.

The propeller hub 52 is supported by the duct hub 42 so as to be rotatable in the C direction with respect to the duct hub 42. That is, the propeller 50 including the propeller hub 52 is rotatable in the C direction with respect to the duct 40 including the duct hub 42. Rotation of the propeller 50 generates a thrust to propel the marine vessel 110.

An annular recess 41*a* is provided on a surface of the duct ring 41 on the R1 side. The rim 51 of the propeller 50 is located in the annular recess 41*a*.

Figure 3:
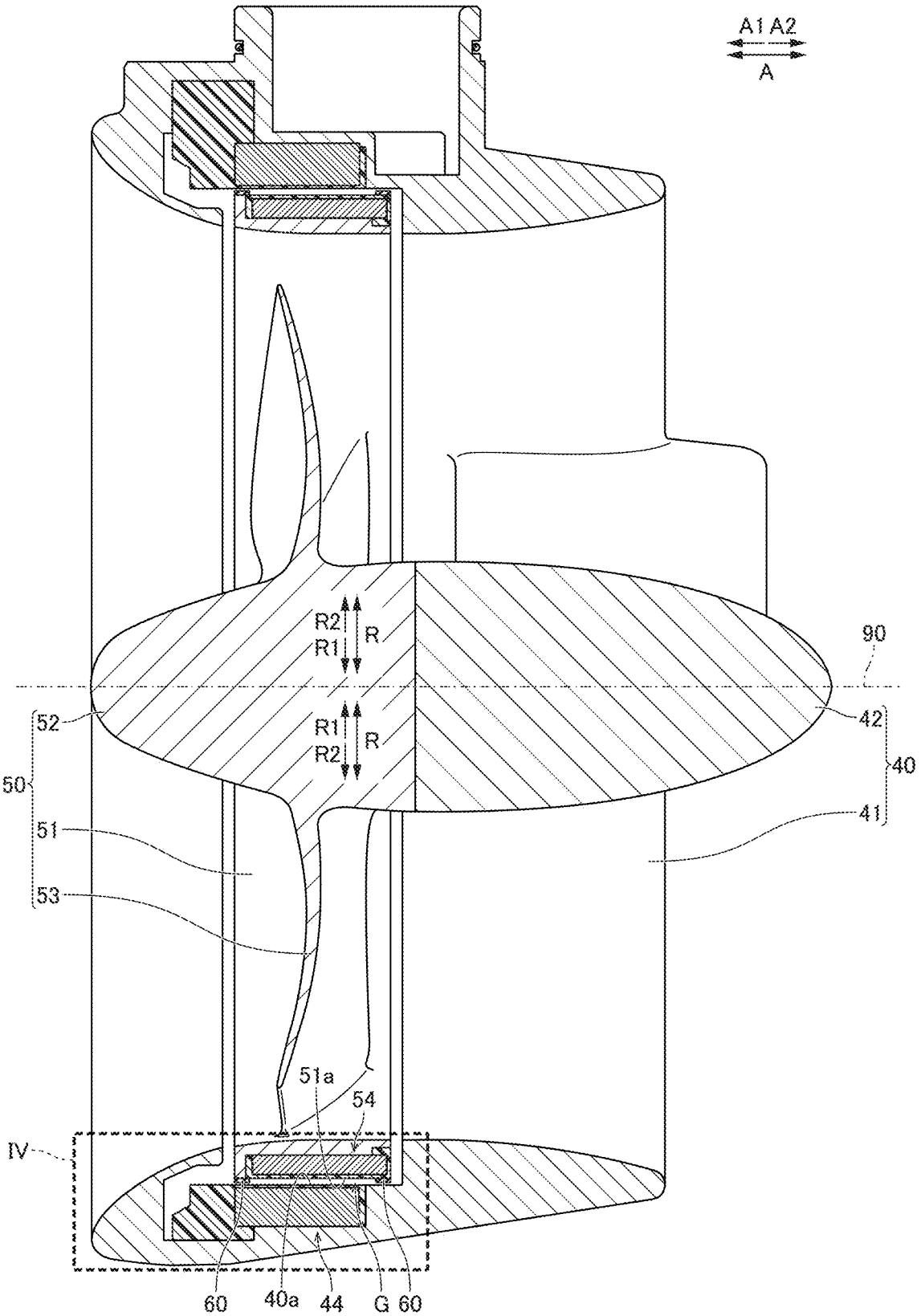
FIG. 3 is a sectional view illustrating the structure of a duct and a rim of a marine propulsion device according to a preferred embodiment of the present invention.

As shown in FIG. 3, the duct ring 41 (duct 40) includes a stator 44. The rim 51 (propeller 50) includes the rotor 54. The rotor 54 is located on the R1 side of the stator 44 so as to face the stator 44. A motor that rotates the propeller 50 includes the stator 44 and the rotor 54. That is, the marine propulsion device 100 is an electric outboard motor.

Figure 4:
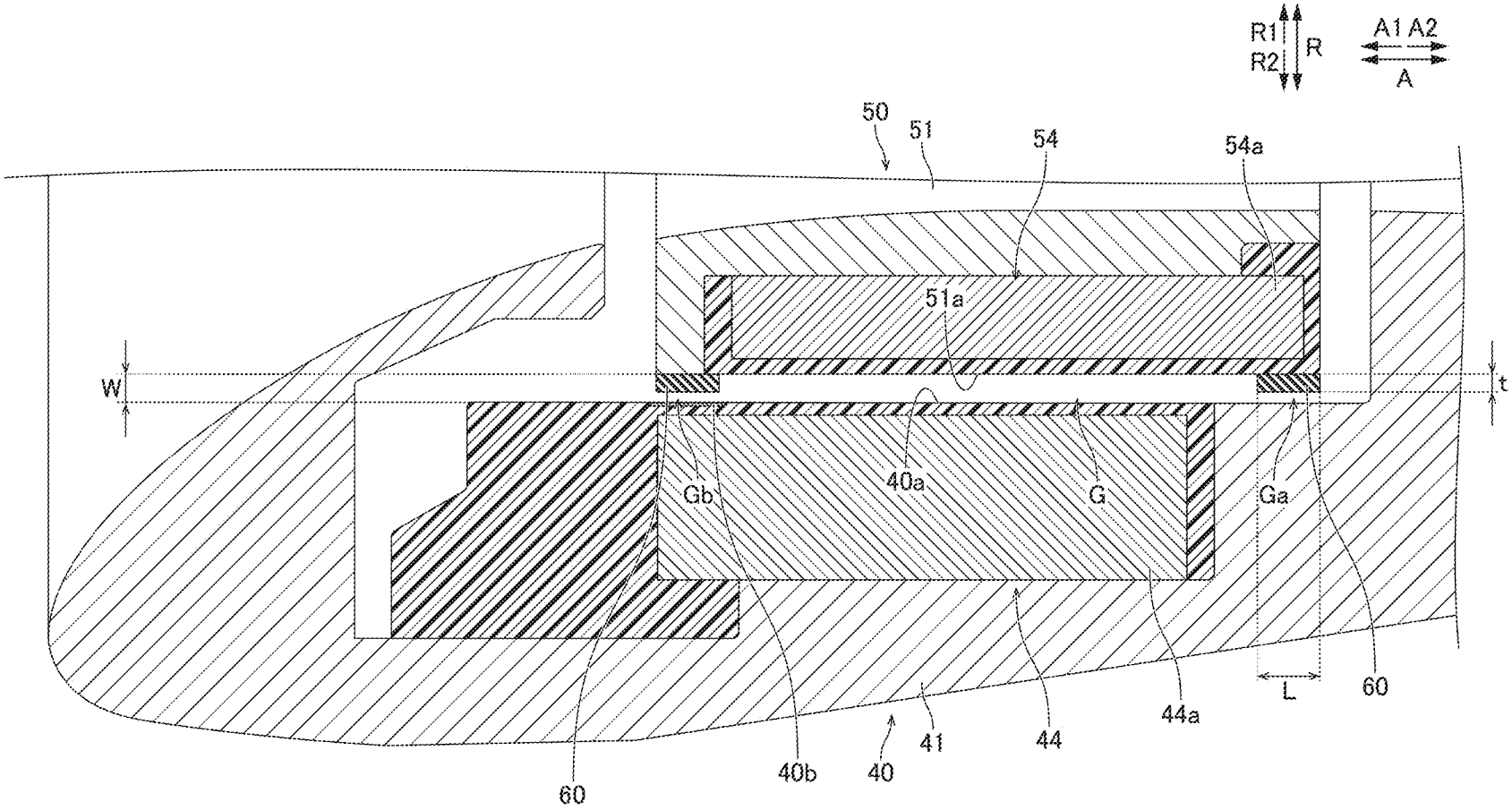
FIG. 4 is an enlarged view of a portion IV in FIG. 3.
Figure 5:
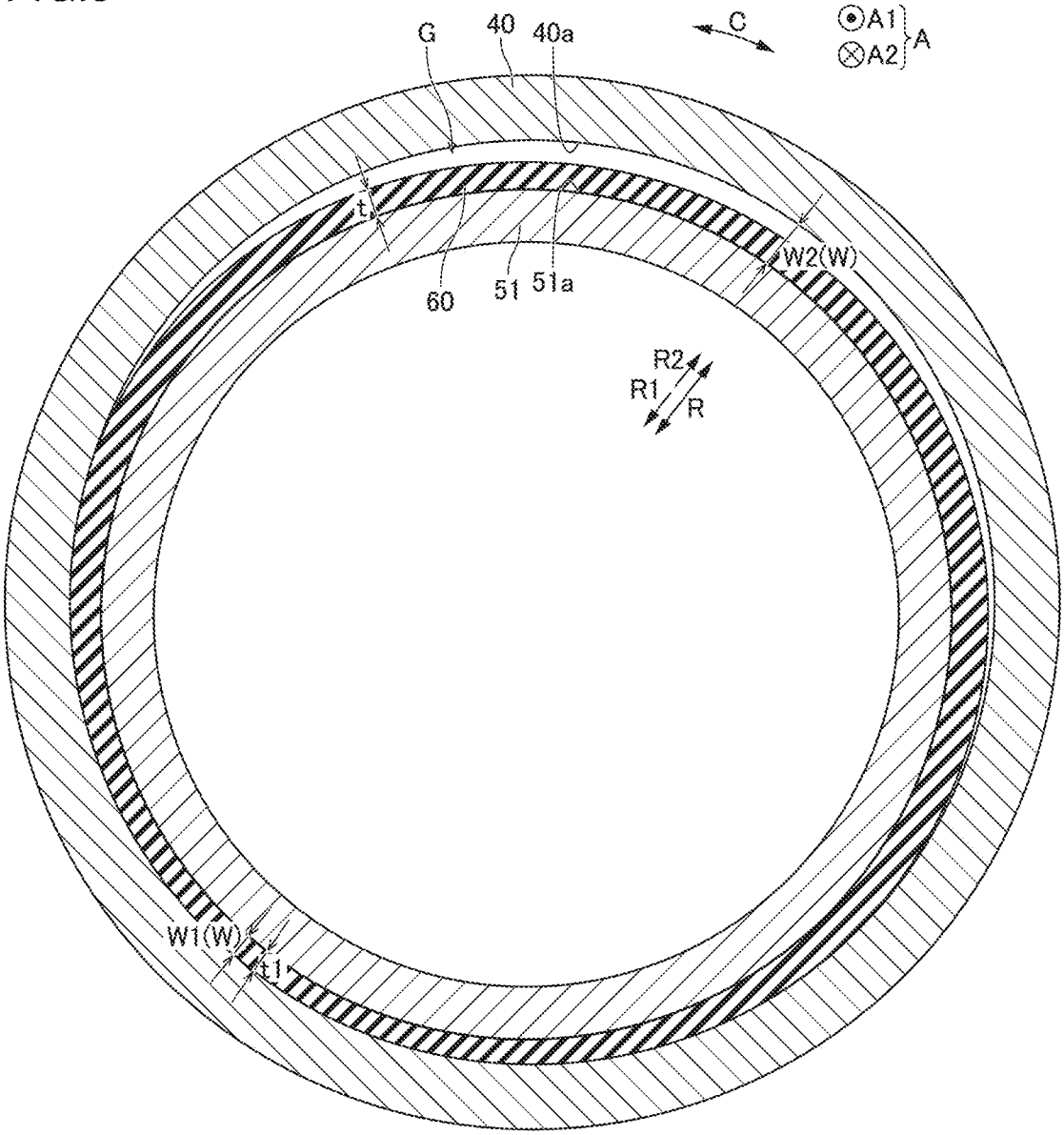
FIG. 5 is a schematic view illustrating a relationship between the thickness of an entry suppressor and a width of a gap between an inner peripheral surface of a duct and an outer peripheral surface of a rim in a radial direction of a rotor of a marine propulsion device according to a preferred embodiment of the present invention.

As shown in FIG. 4, a gap G is provided between the outer peripheral surface 51*a* of the rim 51 and the inner peripheral surface 40*a* of the duct 40 in the R direction. The gap G extends along the A direction. One end 54*a* (an end on the A2 side) of the rotor 54 in the A direction and one end 44*a* (an end on the A2 side) of the stator 44 in the A direction are deviated from each other in the A direction. As shown in FIG. 5, the gap G extends along the C direction.

As shown in FIG. 4, each of the rotor 54 and the stator 44 is covered with a resin. Thus, the gap G is defined by the outer peripheral surface 51*a* of the rim 51 made of the resin covering the rotor 54 and the inner peripheral surface 40*a* of the duct 40 made of the resin covering the stator 44. Each of the rotor 54 and the stator 44 is resin-molded.

As shown in FIG. 5, a width W (the width of the gap G) in the R direction between the outer peripheral surface 51*a* of the rim 51 made of the resin covering the rotor 54 and the inner peripheral surface 40*a* of the duct 40 made of the resin covering the stator 44 is non-uniform in the C direction. The width W in the R direction between the outer peripheral surface 51*a* of the rim 51 and the inner peripheral surface 40*a* of the duct 40 is non-uniform due to the accuracy of resin molding or the processing accuracy of the duct 40 and the rim 51 before resin molding, for example. That is, the gap G between the inner peripheral surface 40*a* of the duct 40 and the outer peripheral surface 51*a* of the rim 51 is non-uniform in the C direction due to manufacturing errors (tolerances) of the duct 40 and the rim 51.

As shown in FIG. 4, the marine propulsion device 100 includes entry suppressors 60 that reduce or prevent entry of foreign matter including gravel into the gap G between the inner peripheral surface 40*a* of the duct 40 and the outer peripheral surface 51*a* of the rim 51 in the R direction. As shown in FIG. 5, the entry suppressors 60 are provided circumferentially between the inner peripheral surface 40*a* of the duct 40 and the outer peripheral surface 51*a* of the rim 51 in the R direction.

The entry suppressors 60 are made of an expansible and shrinkable foamed rubber. That is, the entry suppressors 60 are made of an expansible and shrinkable material. Furthermore, the entry suppressors 60 are made of a non-magnetic material.

As shown in FIG. 4, the entry suppressors 60 made of the foamed rubber are attached to the outer peripheral surface 51*a* of the rim 51 in the gap G. The entry suppressors 60 are attached to the outer peripheral surface 51*a* of the rim 51 with an adhesive, for example. In the gap G, a wear suppression layer 40*b* is provided on the inner peripheral surface 40*a* of the duct 40 facing the entry suppressors 60 made of the foamed rubber to reduce or prevent wear caused by foreign matter adhering to the foamed rubber. The wear suppression layer 40*b* is a ceramic coating, for example.

The entry suppressors 60 are provided separately at a first end Ga (an end on the A2 side) and a second end Gb (an end on the A1 side) in the A direction of the gap G extending in the A direction, respectively. Thus, the entry suppressor 60 provided at the first end Ga (the end on the A2 side) of the gap G in the A direction is provided at a position corresponding, in the A direction, to one end 54*a* (the end on the A2 side) of the rotor 54 in the A direction and not corresponding, in the A direction, to one end 44*a* (the end on the A2 side) of the stator 44 in the A direction. The entry suppressor 60 provided at the first end Ga (the end on the A2 side) of the gap G in the A direction and the entry suppressor 60 provided at the second end Gb (the end on the A1 side) of the gap G in the A direction may be completely the same as each other or may be different from each other.

As shown in FIG. 5, in the R direction, the thickness t of the entry suppressor 60 made of the expansible and shrinkable material is larger than the minimum width W1 of the gap G and smaller than the maximum width W2 of the gap G. Therefore, in a portion of the gap G having the minimum width W1, the entry suppressors 60 are shrunk to a thickness t1 that is substantially the same as the minimum width W1 of the gap G. On the other hand, in the vicinity of a portion of the gap G having the maximum width W2, the entry suppressors 60 do not contact the inner peripheral surface 40*a* of the duct 40. The thicknesses t of the entry suppressors 60 refer to the thicknesses of the entry suppressors 60 in an unshrunk state.

In the R direction, a difference between the thicknesses t of the entry suppressors 60 made of the expansible and shrinkable material and the maximum width W2 of the gap G are smaller than the minimum width W1 of the gap G. In other words, in the R direction, the thicknesses t of the entry suppressors 60 made of the expansible and shrinkable material are larger than a difference between the maximum width W2 of the gap G and the minimum width W1 of the gap G. In such a case, in the R direction, the maximum particle size of foreign matter entering the gap G is smaller than the minimum width W1 of the gap G, and thus catching in the gap G of the foreign matter entering the gap G is reduced or prevented. As shown in FIG. 4, the lengths L of the entry suppressors 60 in the A direction are larger than the thicknesses t of the entry suppressors 60 in the R direction.

According to the various preferred embodiments of the present invention described above, the following advantageous effects are achieved.

According to a preferred embodiment of the present invention, in the R direction (the radial direction of the rotor 54), the thicknesses t of the entry suppressors 60 made of the expansible and shrinkable material are larger than the minimum width W1 of the gap G and smaller than the maximum width W2 of the gap G. Accordingly, in the portion of the gap G having the minimum width W1, the entry suppressors 60 are shrunk to the thickness t1 that is substantially the same as the minimum width W1 of the gap G, and contact the inner peripheral surface 40*a* of the duct 40. Furthermore, in the vicinity of the portion of the gap G having the maximum width W2, the entry suppressors 60 do not contact the inner peripheral surface 40*a* of the duct 40. Thus, the entry suppressors 60 contact the duct 40 only partially in the C direction (the circumferential direction of the rotor 54), and thus a frictional force generated between the entry suppressors 60 and the duct 40 when the rim 51 rotates is reduced as compared with a case in which the entry suppressors 60 contact the duct 40 over the entire circumference. Furthermore, each of the entry suppressors 60 in the marine propulsion device 100 according to the preferred embodiment of the present invention having a thickness t larger than the minimum width W1 of the gap G and smaller than the maximum width W2 of the gap G and made of the expansible and shrinkable material has a simple structure as compared with an entry suppressor in a conventional marine propulsion device in which slits each having a width smaller than a gap between the inner peripheral surface of a duct and the outer peripheral surface of a rim are provided over the entire circumference. Consequently, entry of foreign matter into the gap G between the inner peripheral surface 40*a* of the duct 40 and the outer peripheral surface 51*a* of the rim 51 is reduced or prevented without providing entry suppressors each having a relatively complex structure, while an increase in the amount of power consumed to rotate the rim 51 and a decrease in the maximum output of the motor are reduced or prevented.

According to a preferred embodiment of the present invention, in the R direction (the radial direction of the rotor 54), the difference between the thicknesses t of the entry suppressors 60 made of the expansible and shrinkable material and the maximum width W2 of the gap G is smaller than the minimum width W1 of the gap G. Accordingly, the maximum particle size of foreign matter entering the gap G is smaller than the minimum width W1 of the gap G, and thus catching in the gap G of the foreign matter entering the gap G is reduced or prevented. Thus, wear of the inner peripheral surface 40*a* of the duct 40 and the outer peripheral surface 51*a* of the rim 51 caused by the foreign matter entering the gap G is reduced or prevented.

According to a preferred embodiment of the present invention, each of the rotor 54 and the stator 44 is covered with the resin. The entry suppressors 60 are provided between the outer peripheral surface 51*a* of the rim 51 made of the resin covering the rotor 54 and the inner peripheral surface 40*a* of the duct 40 made of the resin covering the stator 44 in the R direction (the radial direction of the rotor 54). Accordingly, entry of foreign matter into the gap G is reduced or prevented by the entry suppressors 60 such that wear of the inner peripheral surface 40*a* of the duct 40 and the outer peripheral surface 51*a* of the rim 51, both of which are made of the resin that wears more easily than metal, is effectively reduced or prevented.

According to a preferred embodiment of the present invention, the width W (the width of the gap G) in the R direction (the radial direction of the rotor 54) between the outer peripheral surface 51*a* of the rim 51 made of the resin covering the rotor 54 and the inner peripheral surface 40*a* of the duct 40 made of the resin covering the stator 44 is non-uniform in the C direction (the circumferential direction of the rotor 54). Accordingly, assuming that the thicknesses t of the entry suppressors 60 in the R direction are constant, a structure in which the thicknesses t of the entry suppressors 60 are larger than the minimum width W1 of the gap G and smaller than the maximum width W2 of the gap G in the R direction is reliably achieved.

According to a preferred embodiment of the present invention, the entry suppressors 60 are made of the expansible and shrinkable foamed rubber. Accordingly, the entry suppressors 60 are easily shrunk to be smaller than the minimum width W1 of the gap G.

According to a preferred embodiment of the present invention, the entry suppressors 60 made of the foamed rubber is attached to the outer peripheral surface 51*a* of the rim 51 in the gap G. Accordingly, the entry suppressors 60 are easily provided in the gap G between the inner peripheral surface 40*a* of the duct 40 and the outer peripheral surface 51*a* of the rim 51. Furthermore, the wear suppression layer 40*b* is provided on the inner peripheral surface 40*a* of the duct 40 facing the entry suppressors 60 made of the foamed rubber in the gap G to reduce or prevent wear caused by foreign matter adhering to the foamed rubber. Accordingly, when foreign matter adheres to the foamed rubber of which the entry suppressors 60 are made, the wear suppression layer 40*b* reduces or prevents wear of the inner peripheral surface 40*a* of the duct 40 facing the entry suppressors 60 made of the foamed rubber, caused by the foreign matter.

According to a preferred embodiment of the present invention, the entry suppressors 60 are attached to the outer peripheral surface 51*a* of the rim 51 in the gap G. Attachment work to attach the circumferentially provided entry suppressors 60 to the outer peripheral surface 51*a* of the rim 51 from the R2 side (the radial outside of the rotor 54) is easier than attachment work to attach the circumferentially provided entry suppressors 60 to the inner peripheral surface 40*a* of the duct 40 from the R1 side (the radial inside of the rotor 54). Therefore, as compared with a case in which the entry suppressors 60 are attached to the inner peripheral surface 40*a* of the duct 40 in the gap G, the entry suppressors 60 are easily provided in the gap G between the inner peripheral surface 40*a* of the duct 40 and the outer peripheral surface 51*a* of the rim 51. Furthermore, the entry suppressors 60 are placed on the upper side in the gap G on the lower side between the inner peripheral surface 40*a* of the duct 40 and the outer peripheral surface 51*a* of the rim 51, and thus catching in the entry suppressors 60 of foreign matter entering the gap G on the lower side between the inner peripheral surface 40*a* of the duct 40 and the outer peripheral surface 51*a* of the rim 51 is reduced or prevented when a state in which the duct 40 and the rim 51 are submerged in water has changed to a state in which the duct 40 and the rim 51 are not submerged in water.

According to a preferred embodiment of the present invention, the entry suppressors 60 are made of the non-magnetic material. Accordingly, the magnetic influence of the entry suppressors 60 on the rotor 54 when the rim 51 including the rotor 54 rotates is reduced or prevented. That is, a decrease in the performance of the motor including the stator 44 of the duct 40 and the rotor 54 of the rim 51 is reduced or prevented.

According to a preferred embodiment of the present invention, the lengths L of the entry suppressors 60 in the A direction (the axial direction of the rotor 54) are larger than the thicknesses t of the entry suppressors 60 in the R direction (the radial direction of the rotor 54). Accordingly, the lengths L of the entry suppressors 60 in the A direction are relatively large, and thus the attachment areas of the entry suppressors 60 to the inner peripheral surface 40*a* of the duct 40 or the outer peripheral surface 51*a* of the rim 51 become relatively large. Thus, the entry suppressors 60 are relatively firmly attached to the inner peripheral surface 40*a* of the duct 40 or the outer peripheral surface 51*a* of the rim 51.

According to a preferred embodiment of the present invention, the gap G extends in the A direction (the axial direction of the rotor 54). The entry suppressors 60 are provided separately at the first end Ga and the second end Gb in the A direction of the gap G extending in the A direction, respectively. Accordingly, as compared with a case in which the entry suppressors 60 are provided in portions of the gap G other than the first end Ga and the second end Gb in the A direction, entry of foreign matter into the gap G is effectively reduced or prevented. Furthermore, as compared with a case in which the entry suppressors 60 are provided in the portions of the gap G other than the first end Ga and the second end Gb in the A direction in addition to the first end Ga and the second end Gb of the gap G in the A direction, areas in which the entry suppressors 60 contact the rim 51 are reduced such that a frictional force generated between the entry suppressors 60 and the rim 51 when the rim 51 rotates is reduced.

According to a preferred embodiment of the present invention, one end 54*a* of the rotor 54 in the A direction (the axial direction of the rotor 54) and one end 44*a* of the stator 44 in the A direction are deviated from each other in the A direction. The entry suppressor 60 provided at the first end Ga of the gap G in the A direction is provided at the position corresponding, in the A direction, to one end 54*a* of the rotor 54 in the A direction and not corresponding, in the A direction, to one end 44*a* of the stator 44 in the A direction. Accordingly, even when one end 54*a* of the rotor 54 in the A direction and one end 44*a* of the stator 44 in the A direction are deviated from each other in the A direction, the entry suppressor 60 is provided at the first end Ga in the A direction of the gap G extending in the A direction.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while one end 54*a* of the rotor 54 in the A direction (the axial direction of the rotor 54) and one end 44*a* of the stator 44 in the A direction are preferably deviated from each other in the A direction, and the entry suppressor 60 provided at the first end Ga of the gap G in the A direction is preferably provided at the position corresponding, in the A direction, to one end 54*a* of the rotor 54 in the A direction and not corresponding, in the A direction, to one end 44*a* of the stator 44 in the A direction in preferred embodiments described above, the present invention is not restricted to this. In a preferred embodiment of the present invention, one end of the rotor in the axial direction and one end of the stator in the axial direction may alternatively be located at the same position in the axial direction, and the entry suppressor provided at the first end of the gap in the axial direction may alternatively be provided at a position corresponding, in the axial direction, to one end of the rotor in the axial direction and one end of the stator in the axial direction.

While the gap G preferably extends in the A direction (the axial direction of the rotor 54), and the entry suppressors 60 are preferably provided separately at the first end Ga and the second end Gb in the A direction of the gap G extending in the A direction, respectively in preferred embodiments described above, the present invention is not restricted to this. In a preferred embodiment of the present invention, the entry suppressors may alternatively be provided in positions other than the first end and the second end of the gap in the axial direction of the rotor in addition to the first end and the second end in the axial direction of the rotor of the gap extending in the axial direction of the rotor. Furthermore, the entry suppressor may alternatively be integral from the first end to the second end in the axial direction of the rotor of the gap extending in the axial direction of the rotor. Moreover, the entry suppressor may not be provided at the first end in the axial direction of the rotor of the gap extending in the axial direction of the rotor or may not be provided at the second end in the axial direction of the rotor of the gap extending in the axial direction of the rotor.

While the lengths L of the entry suppressors 60 in the A direction (the axial direction of the rotor 54) are preferably larger than the thicknesses t of the entry suppressors 60 in the R direction (the radial direction of the rotor 54) in preferred embodiments described above, the present invention is not restricted to this. In a preferred embodiment of the present invention, the lengths of the entry suppressors in the axial direction of the rotor may alternatively be equal to or less than the thicknesses of the entry suppressors in the radial direction of the rotor.

While the entry suppressors 60 are preferably made of the non-magnetic material in preferred embodiments described above, the present invention is not restricted to this. In a preferred embodiment of the present invention, the entry suppressors may alternatively be made of a magnetic material.

While the entry suppressors 60 are preferably attached to the outer peripheral surface 51*a* of the rim 51 in the gap G in preferred embodiments described above, the present invention is not restricted to this. In a preferred embodiment of the present invention, the entry suppressors 60 may alternatively be attached to the inner peripheral surface 40*a* of the duct 40 in the gap G.

While the entry suppressors 60 made of the foamed rubber are preferably attached to the outer peripheral surface 51*a* of the rim 51 in the gap G, and the wear suppression layer 40*b* is preferably provided on the inner peripheral surface 40*a* of the duct 40 facing the entry suppressors 60 made of the foamed rubber in the gap G to reduce or prevent wear caused by foreign matter adhering to the foamed rubber in preferred embodiments described above, the present invention is not restricted to this. In a preferred embodiment of the present invention, the entry suppressors made of the foamed rubber may alternatively be attached to the inner peripheral surface of the duct in the gap, and the wear suppression layer may alternatively be provided on the outer peripheral surface of the rim facing the entry suppressors made of the foamed rubber in the gap to reduce or prevent wear caused by foreign matter adhering to the foamed rubber. Also in such a case, the entry suppressors are easily provided in the gap between the inner peripheral surface of the duct and the outer peripheral surface of the rim, similarly to the preferred embodiments described above. Furthermore, when foreign matter adheres to the foamed rubber of which the entry suppressors are made, the wear suppression layer reduces or prevents wear of the outer peripheral surface of the rim facing the entry suppressors made of the foamed rubber, caused by the foreign matter.

While the entry suppressors are preferably made of the expansible and shrinkable foamed rubber in preferred embodiments described above, the present invention is not restricted to this. In a preferred embodiment of the present invention, the entry suppressors may alternatively be made of an expansible and shrinkable material other than the foamed rubber (such as a rubber-based material other than foamed rubber).

While each of the rotor 54 and the stator 44 is preferably covered with the resin, and the entry suppressors 60 are preferably provided between the outer peripheral surface 51*a* of the rim 51 made of the resin covering the rotor 54 and the inner peripheral surface 40*a* of the duct 40 made of the resin covering the stator 44 in the R direction (the radial direction of the rotor 54) in preferred embodiments described above, the present invention is not restricted to this. In a preferred embodiment of the present invention, the rotor and the stator may alternatively be covered with the resin and a member (metal, for example) other than the resin, respectively, and the entry suppressors may alternatively be provided between the outer peripheral surface of the rim made of the resin covering the rotor and the inner peripheral surface of the duct made of the member other than the resin covering the stator in the radial direction of the rotor. Furthermore, the rotor and the stator may alternatively be covered with a member other than the resin and the resin, respectively, and the entry suppressors may alternatively be provided between the outer peripheral surface of the rim made of the member other than the resin covering the rotor and the inner peripheral surface of the duct made of the resin covering the stator in the radial direction of the rotor. Moreover, each of the rotor and the stator may alternatively be covered with a member other than the resin, and the entry suppressors may alternatively be provided between the outer peripheral surface of the rim made of the member other than the resin covering the rotor and the inner peripheral surface of the duct made of the member other than the resin covering the stator in the radial direction of the rotor.

While the difference between the thicknesses t of the entry suppressors 60 made of the expansible and shrinkable material and the maximum width W2 of the gap G is preferably smaller than the minimum width W1 of the gap G in the R direction (the radial direction of the rotor 54) in preferred embodiments described above, the present invention is not restricted to this. In a preferred embodiment of the present invention, the difference between the thicknesses of the entry suppressors made of the expansible and shrinkable material and the maximum width of the gap may alternatively be equal to or larger than the minimum width of the gap in the radial direction of the rotor.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine propulsion device comprising:

a duct including a stator;

a propeller including a rim including a rotor radially inward of the stator and facing the stator, and blades radially inward of the rim; and an entry suppressor made of an expansible and shrinkable material and extending circumferentially in a gap defined by an inner peripheral surface of the duct and an outer peripheral surface of the rim in a radial direction of the rotor to reduce or prevent entry of foreign matter into the gap; wherein the entry suppressor has a thickness larger than a minimum width of the gap and smaller than a maximum width of the gap in the radial direction.

2. The marine propulsion device according to claim 1, wherein in the radial direction, a difference between the thickness of the entry suppressor and the maximum width of the gap is smaller than the minimum width of the gap.

3. The marine propulsion device according to claim 1, wherein each of the rotor and the stator is covered with a resin; and the entry suppressor is between the outer peripheral surface of the rim made of the resin covering the rotor and the inner peripheral surface of the duct made of the resin covering the stator in the radial direction.

4. The marine propulsion device according to claim 3, wherein a width in the radial direction between the outer peripheral surface of the rim and the inner peripheral surface of the duct is non-uniform in a circumferential direction of the rotor.

5. The marine propulsion device according to claim 1, wherein the entry suppressor is made of an expansible and shrinkable foamed rubber.

6. The marine propulsion device according to claim 5, wherein the entry suppressor is attached to either the inner peripheral surface of the duct or the outer peripheral surface of the rim; and the marine propulsion device further comprises a wear suppression layer on either the outer peripheral surface of the rim or the inner peripheral surface of the duct facing the entry suppressor to reduce or prevent wear caused by the foreign matter adhering to the entry suppressor.

7. The marine propulsion device according to claim 1, wherein the entry suppressor is attached to the outer peripheral surface of the rim.

8. The marine propulsion device according to claim 1, wherein the entry suppressor is made of a non-magnetic material.

9. The marine propulsion device according to claim 1, wherein the entry suppressor is attached to either the inner peripheral surface of the duct or the outer peripheral surface of the rim.

10. The marine propulsion device according to claim 9, wherein the entry suppressor has a length in an axial direction of the rotor larger than the thickness of the entry suppressor in the radial direction.

11. The marine propulsion device according to claim 1, wherein the gap extends in an axial direction of the rotor; and the entry suppressor includes a first entry suppressor at a first axial end of the gap and a second entry suppressor at a second axial end of the gap.

12. The marine propulsion device according to claim 11, wherein one end of the rotor in the axial direction and one end of the stator in the axial direction are deviated from each other in the axial direction; and the first entry suppressor at the first axial end of the gap corresponds to a position of the one end of the rotor in the axial direction, and does not correspond to a position of the one end of the stator in the axial direction.

13. A marine vessel comprising:

a hull; and a marine propulsion device attached to the hull; wherein the marine propulsion device includes:

a duct including a stator;

a propeller including a rim including a rotor radially inward of the stator and facing the stator, and blades radially inward of the rim; and an entry suppressor made of an expansible and shrinkable material and extending circumferentially in a gap defined by an inner peripheral surface of the duct and an outer peripheral surface of the rim in a radial direction of the rotor to reduce or prevent entry of foreign matter into the gap; and the entry suppressor has a thickness larger than a minimum width of the gap and smaller than a maximum width of the gap in the radial direction.

14. The marine vessel according to claim 13, wherein in the radial direction, a difference between the thickness of the entry suppressor and the maximum width of the gap is smaller than the minimum width of the gap.

15. The marine vessel according to claim 13, wherein each of the rotor and the stator is covered with a resin; and the entry suppressor is between the outer peripheral surface of the rim made of the resin covering the rotor and the inner peripheral surface of the duct made of the resin covering the stator in the radial direction.

16. The marine vessel according to claim 15, wherein a width in the radial direction between the outer peripheral surface of the rim and the inner peripheral surface of the duct is non-uniform in a circumferential direction of the rotor.

17. The marine vessel according to claim 13, wherein the entry suppressor is made of an expansible and shrinkable foamed rubber.

18. The marine vessel according to claim 17, wherein the entry suppressor is attached to either the inner peripheral surface of the duct or the outer peripheral surface of the rim; and the marine propulsion device further includes a wear suppression layer on either the outer peripheral surface of the rim or the inner peripheral surface of the duct facing the entry suppressor to reduce or prevent wear caused by the foreign matter adhering to the entry suppressor.

19. The marine vessel according to claim 13, wherein the entry suppressor is attached to the outer peripheral surface of the rim.

20. The marine vessel according to claim 13, wherein the entry suppressor is made of a non-magnetic material.

* * * * *